US006736467B2

(12) United States Patent
Kuvshinikov

(10) Patent No.: US 6,736,467 B2
(45) **Date of Patent: *May 18, 2004**

(54) ADJUSTABLE PIER WALL SYSTEM

(75) Inventor: Daniel Kuvshinikov, Pasadena, CA (US)

(73) Assignee: Kushwood Manufacturing, Inc., Ontario, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/145,556

(22) Filed: May 13, 2002

(65) Prior Publication Data

US 2002/0125797 A1 Sep. 12, 2002

Related U.S. Application Data

(63) Continuation of application No. 09/534,581, filed on Mar. 27, 2000, now Pat. No. 6,402,272.

(51) Int. Cl.[7] ..... A47B 45/00
(52) U.S. Cl. ..... 312/205
(58) Field of Search ..... 312/205, 7.2, 204, 312/111, 107, 198, 257.1, 245, 246, 263, 334.8

(56) References Cited

U.S. PATENT DOCUMENTS

| | | | | | |
|---|---|---|---|---|---|
| 1,877,401 | A | * | 9/1932 | Hildebrand | 312/334.8 X |
| 2,326,087 | A | * | 8/1943 | Willard | 312/334.8 X |
| 3,353,885 | A | * | 11/1967 | Hanson | 312/205 |
| 5,303,057 | A | | 4/1994 | Davidow et al. | |
| 5,718,493 | A | * | 2/1998 | Nikolai | 312/245 |
| 5,795,041 | A | | 8/1998 | Weaver | |
| 6,113,201 | A | * | 9/2000 | Bauer | 312/245 |
| 6,283,563 | B1 | | 9/2001 | Lambright et al. | |

FOREIGN PATENT DOCUMENTS

| | | | | |
|---|---|---|---|---|
| CH | 63474 | * | 2/1913 | 312/205 |
| DE | 129923 | * | 8/1901 | 312/205 |
| DE | 38 38 525 C1 | | 3/1990 | |
| GB | 10285 | * | 2/1901 | 312/205 |

* cited by examiner

*Primary Examiner*—James O. Hansen
(74) *Attorney, Agent, or Firm*—Christie, Parker & Hale, LLP

(57) ABSTRACT

A pier-type wall system with a pair of piers or upright furniture cabinets or the like movably coupled to a bridge mechanism whereby the piers can be moved relative to each other while maintaining an appearance of structural and ornamental continuity between the piers and the bridge mechanism.

28 Claims, 4 Drawing Sheets

ADJUSTABLE PIER WALL SYSTEM

CROSS REFERENCE TO RELATED APPLICATION(S)

The present application is a continuation of application Ser. No. 09/534,581, filed Mar. 27, 2000 now U.S. Pat. No. 6,402,272.

FIELD OF THE INVENTION

This invention is directed to a furniture component, in general, and an adjustable furniture component which retains a desired ornamental appearance, in particular.

SUMMARY OF THE INVENTION

There are many types of furniture known and manufactured throughout the world. Certain types of furniture are referred to as piers. These are, generally, upright pieces of furniture in the form of cabinets, book cases or the like. Often, two of more of these piers are joined together to form a so-called entertainment center. In these types of furniture, a mid-portion of the unit is open to receive a television set or the like.

However television sets, or other components to be mounted or arranged in the mid-portion of the furniture unit come in many sizes. With a pair of upright piers joined together by a fixed bridge, the mid-portion is fixed in size and configuration. Thus, the size of the component to be installed therein is also fixed and limited.

Likewise, with a fixed furniture unit, the dimensions thereof are fully determined. Thus, the positioning of such a fixed unit is limited to a particular place of location in a dwelling place. This fact limits the decorative flexibility of such a unit which is, typically, fairly expensive. Consequently, with these shortcomings, it is desirable to have an adjustable unit which maintains the beauty and style of a fixed unit.

DESCRIPTION OF A PREFERRED EMBODIMENT

Figure 2:
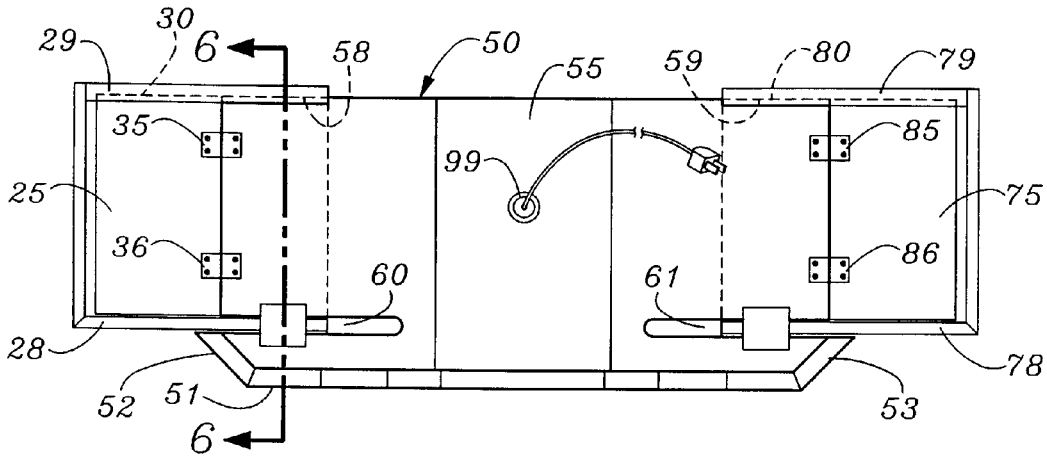
FIG. 2 is a top plan view of the system as shown in FIG. 1.

In the following description, common components bear common reference numerals for convenience.

Figure 1:
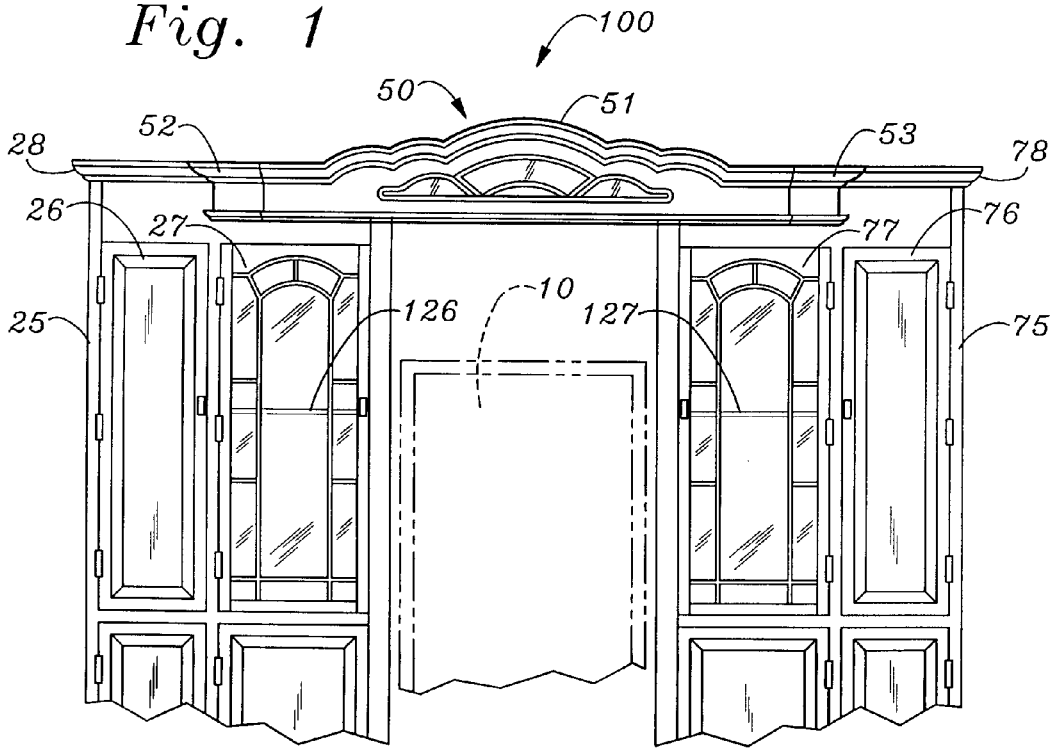
FIG. 1 is a front elevation view of one embodiment of the furniture system of the instant invention in the fully extended position.

Referring now to FIG. 1, there is shown a front elevation view of the expandable furniture or wall system 100 of the instant invention. In this arrangement, the system 100 is fully (or to the extent required) extended in order to receive a large screen television unit 10 (or the like) between the upright piers 25 and 75, respectively. The unit 10 is not a part of the invention, per se.

In this embodiment, the piers 25 and 75 are substantially similar in construction in terms of furniture style. That is, the piers 25 and 75 each include glass doors 26 and 27 or 76 and 77, respectively. Of course, the glass doors, per se, can be omitted and shelves 126 or 176, doors or other configurations of cabinetry can be utilized as deemed necessary and/or desirable. The specific details of the piers is not essential and/or limitative of the invention.

However, for esthetic purposes, the piers 25 and 75 are typically coordinated to each other. In addition, for convenience, each of the piers may be mounted on wheels, rollers or sliders, not shown. The bridge 50 includes, typically, a decorative facia or crown which is fabricated of a suitably attractive trim piece 51. The trim piece 51, typically, extends outwardly from the faces of the piers 25 and 75, respectively. The facia includes a pair of side returns 52 and 53 which, in the preferred embodiment, are angled toward the pier faces. The side returns 52 and 53 are integrally formed with the trim piece 51 in order to provide a unitary component.

The interior ends of the side returns 52 and 53 are carefully formed and arranged so as to carefully fit and conform to the top trim of the piers 25 and 75. Thus, the fascia trim of the bridge 50 is adapted to give the appearance of continuity in trim from the opposite ends of the system 100 irrespective of the relative positions of piers 25 and 75.

Referring now to FIG. 2, there is shown a top plan view of the system 100 including the piers 25 and 75 as well as the bridge 50. The bridge 50 includes the main support plate 55, and the trim fascia 51, as well as the side returns 52 and 53.

In this embodiment, the support plate 55 is multilevel in order to accommodate the optional light fixture 99. However, this construction is not essential to, or required for, the practice of the wall system 100 of the instant invention.

The support plate 55 includes a pair of opposed slots 60 and 61 adjacent to the front outer edges of plate 55 and which extend toward the center of the support plate. In the exemplary embodiment shown in FIG. 2, the slots 60 and 61 are cutouts formed through the entire thickness of the support plate. The length or extent of the slots 60 and 61 is a function of the distance which the piers 25 and 75 move relative to each other and the distance therebetween. The width of the slots 60 and 61 is chosen to slidably engage the top edge portions 28 and 78 of the piers 25 and 75, respectively. This arrangement is shown in greater detail infra.

In conjunction with this slidable arrangement, the tops of the backs 29 and 79 of the piers 25 and 75, respectively, include slots 30 and 80, respectively, to slidably engage and retain the rear edges 58 and 59 of the bridge 50. Thus, the piers 25 and 75 are able to freely move relative to the bridge 50 wherein the space between the facing sides of the piers can define a desired opening therebetween. The defined opening can be nil (when the piers are in abutment) or it can be a relatively large space as defined by the length of bridge 50.

In a preferred embodiment, securing devices such as brackets 35 and 36 are provided relative to the bridge 55 and pier 25. Similarly, brackets 85 and 86 are provided relative to the bridge 55 and pier 75. In a typical application, the brackets are attached to the respective ends of the bridge 55 by appropriate screws or the like.

The brackets are then attached to the top surfaces of the respective piers by appropriate screws or the like. This attachment can be made after both of the piers have been positioned relative to the bridge. Conversely, the brackets at one end of the bridge, e.g. brackets 35 and 36 can be attached to pier 25 and, after adjustment of the piers relative to each other, the brackets 85 and 86 can be attached to pier 75. (The opposite sequence is also contemplated, of course.)

Moreover, it should be clear that the number of brackets is not limited to two at each end of the bridge. The number of brackets may be reduced to one or expanded to three or more. Likewise, the size of the brackets can be chosen as desired.

Referring now to FIG. 3, there is again shown a front elevation view of the expandable furniture or wall system 100 of the instant invention. In this arrangement, the system 100 is fully closed in order to give the appearance of a unitary wall unit. In this case there is no space (or component) between the upright piers 25 and 75, respectively. It must be understood that any arrangement, i.e., space, of the piers intermediate spatial relationships of FIGS. 1 and 3 is permissible.

Figure 3:
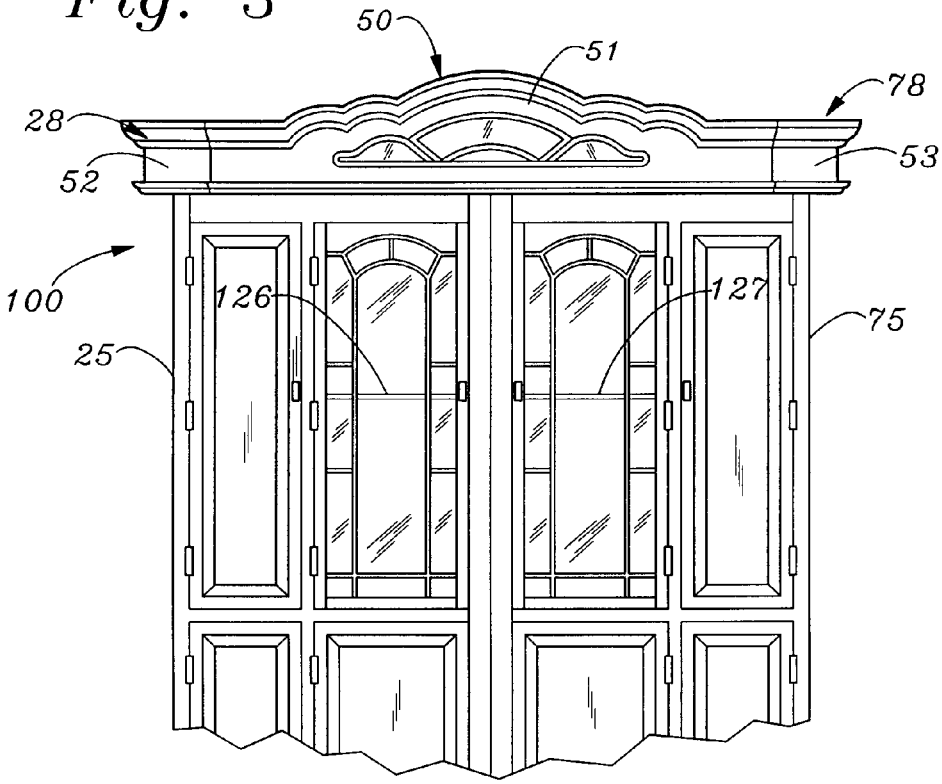
FIG. 3 is a front elevation view of the furniture system shown in FIG. 1 in the closed position.

In FIG. 3, the piers 25 and 75 are, again, substantially similar in construction in terms of furniture style. That is, the piers 25 and 75 each include glass doors 26, 27, 76, 77, and shelves 126, 176 or other configurations as deemed necessary and/or desirable. As noted supra, the specific details of the piers is not essential and/or limitative of the invention.

The bridge 50 includes the decorative fascia fabricated of trim piece 51. The trim piece 51, typically, extends outwardly from the faces of the piers 25 and 75, respectively. The fascia includes a pair of side returns 52 and 53 which, in the preferred embodiment, are angled toward the pier faces. The side returns 52 and 53 are integrally formed with the trim piece 51 in order to provide a unitary component.

The interior ends of the side returns 52 and 53 are carefully formed and arranged so as to carefully fit and conform to the top trim of the piers 25 and 75. Thus, the fascia trim of the bridge 50 is adapted to give the appearance of continuity in trim from the opposite ends of the system 100.

Figure 4:
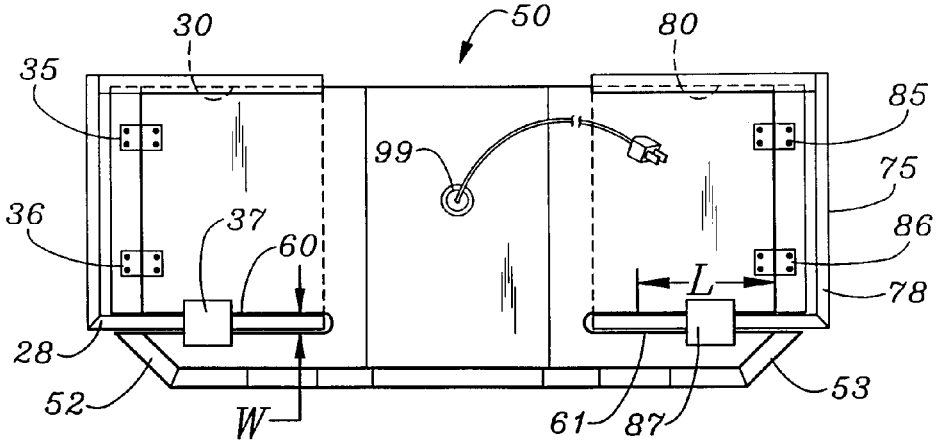
FIG. 4 is a top plan view of the system a shown in FIG. 3.

Referring now to FIG. 4, there is shown a top plan view of the system 100 including the piers 25 and 75 as well as the bridge 50 in the closed position. The bridge 50 includes the main support plate 55, the trim fascia 51, the side returns 52 and 53, and the optional light fixture 99.

The support plate 55 includes the opposed slots 60 and 61 adjacent to the front outer edges of plate 55. The length (L) of the slots is a function of the distance which the piers 25 and 75 move relative to each other and the distance therebetween especially so that the piers can be placed side-by-side in the closed position. The width (W) of the slots 60 and 61 is chosen to slidably engage the tops 28 and 78 of the piers 25 and 75, respectively.

In FIG. 4, the top of the back 29 and 79 of the piers 25 and 75, respectively, include slots 30 and 80, respectively, to slidably engage and retain the rear edges 58 and 59 of the bridge 50. Thus, the piers 25 and 75 are able to freely move relative to the bridge 50 wherein the space between the facing sides of the piers can define a desired opening therebetween. The defined opening can be nil (when the piers are in abutment) or it can be a relatively large space as defined by the length of bridge 50. While shown for continuity, the brackets 35, 36, 85 and/or 86 could be removed when the unit is in this configuration.

In addition, the retainer plates 37 and 87 are shown in FIG. 4. These retainers are, typically, thin plates of metal, wood, plastic or the like which retain and support the support plate 55 on top edge 28 and 78 of upper ends of the trim of the piers 25 and 75 when the slots 60 and 61 pass therethrough.

Figure 5:
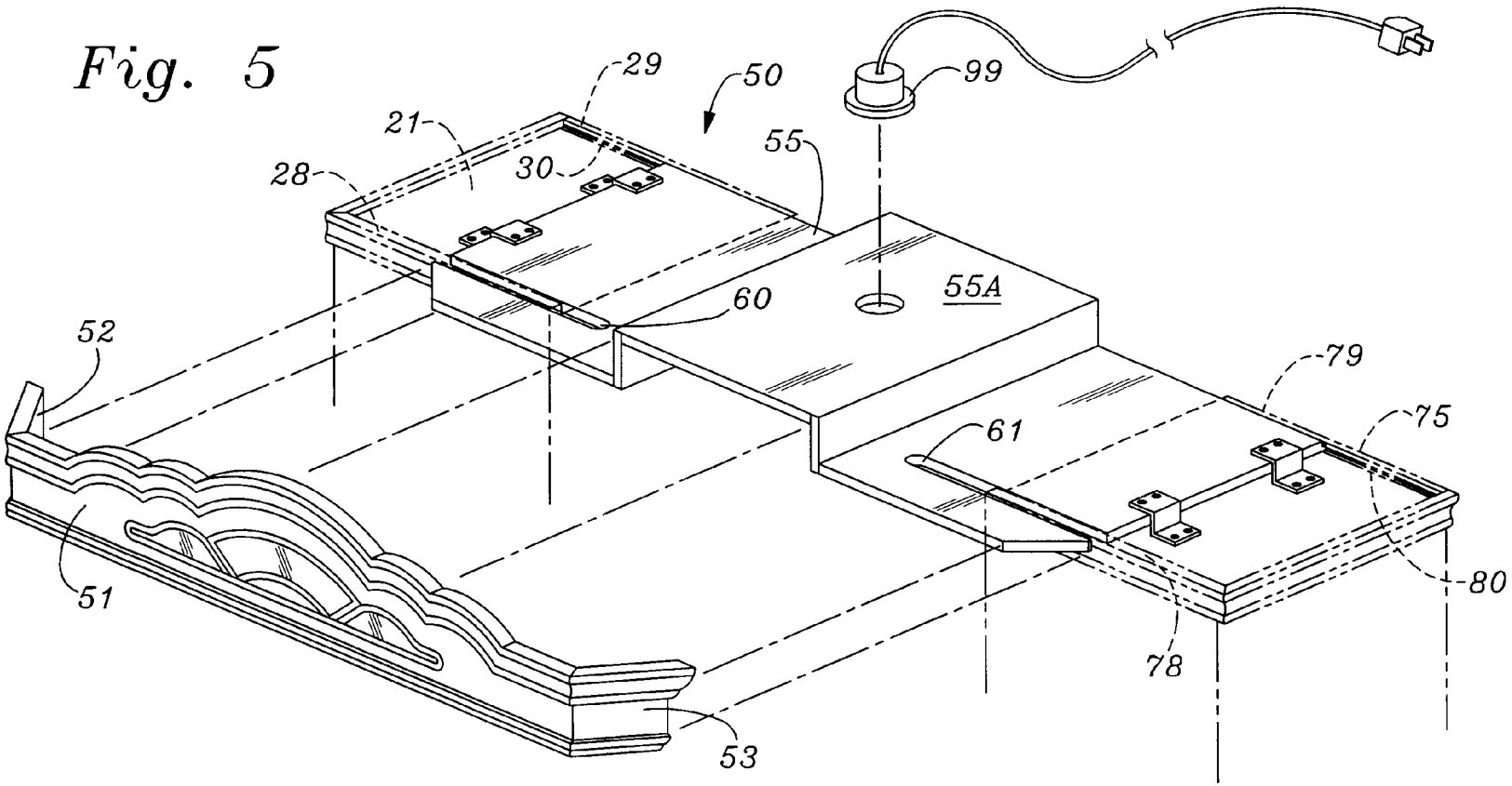
FIG. 5 is an exploded, perspective view of the bridge portion of the system of the instant invention with portions of the respective upright piers.

Referring now to FIG. 5, there is shown a partially exploded, partially broken away oblique view of the bridge 50 and portions of the piers 25 and 75 (shown in dashed outline).

The bridge 50 includes the support plate 55 with the slots 60 and 61 therein. These slots slidably engage the upper front tops or upper ends 28 and 78 of the piers 25 and 75, respectively. The rear tops or upper ends 29 and 79 of the piers 25 and 75, respectively, include the slots 30 and 80 which slidably receive the ends of the plate 55.

As shown, the support plate 55 includes raised portion 55A which supports the optional light fixture 99. In addition, the raised portion 55A adds additional support and bracing for the decorative front face 51 of the movable bridge.

The decorative returns 52 and 53 are, typically, angulated relative to the decorative front face 51. The returns are formed contiguously and integrally with the front face to produce a unitary component. The free ends of the returns 52 and 53 are formed to precisely engage the trim at the upper ends 28 and 78 of the piers whereby the front decorative face of the bridge (face 51 together with returns 52 and 53) appears to be contiguous and integral with the trim elements 28 and 78 of the respective piers. Thus, the bridge 50 and the piers 25 and 75 give the appearance of a single, contiguous unit irrespective of the spacing between the piers 25 and 75. As a result, the single movable unit can provide multiple decorative concepts and appearance. For example, the piers can be side-by-side; the piers can be separated to receive a small TV and stand; or the piers can be separated sufficiently to receive a large screen TV therebetween. A single furniture unit provides multiple decorative possibilities.

Figure 6:
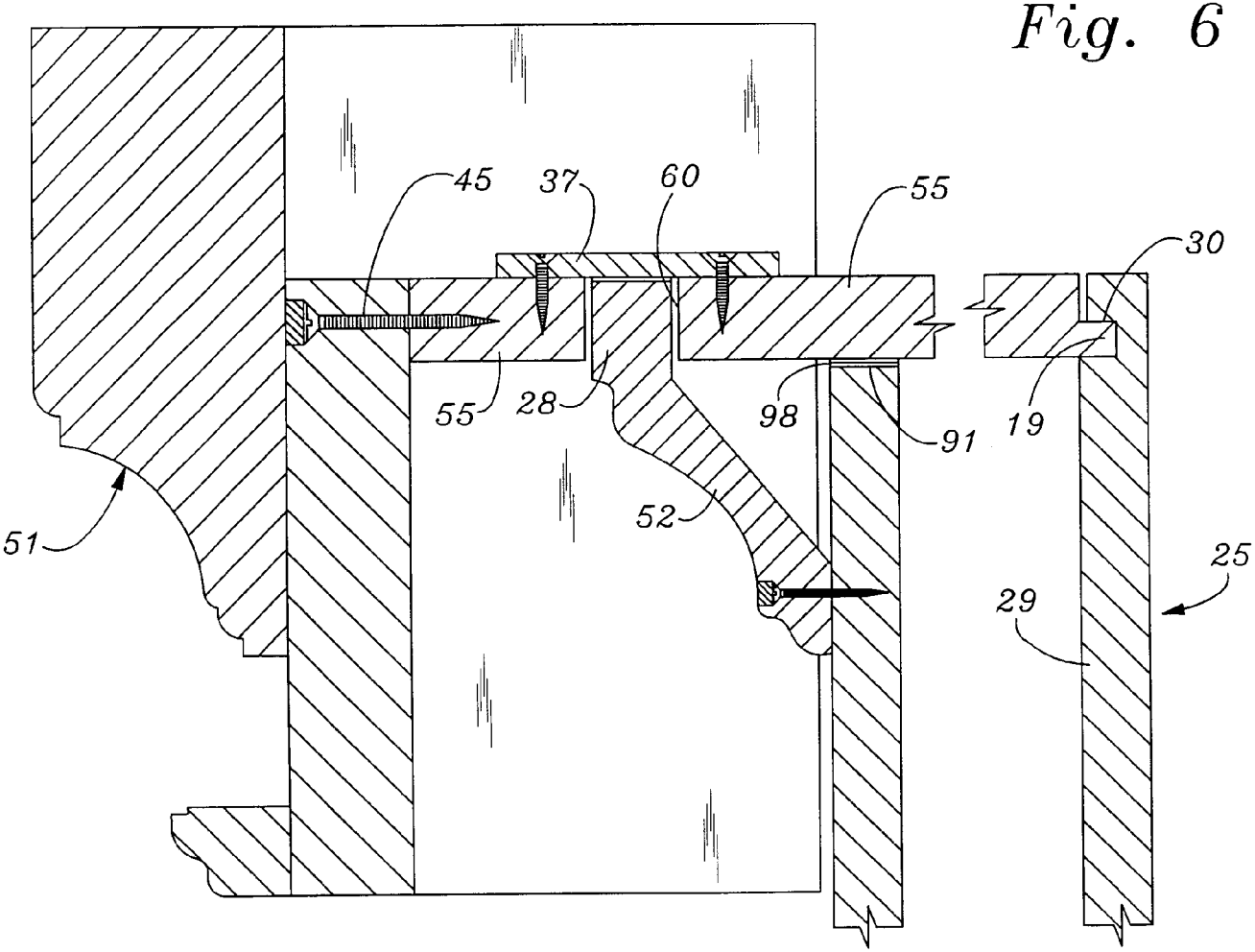
FIG. 6 is an enlarged, cross-sectional view of the interlocking portions of the system as taken along the lines 6—6 in FIG. 2.

Referring now to FIG. 6, there is shown a cross-sectional view of the interacting parts of the pier 25 and the bridge 50. This cross-sectional view is taken along the lines 6—6 in FIG. 2. The fascia 51 of the bridge 50 is attached to the support 55 by suitable means such as screws 45 or the like.

The support 55 rests on the upper edge surface 91 of the pier 25 and slides thereon. For convenience, a suitable slider layer 98 of plastic or the like may be deposited in suitable fashion on the surface 91. The upper edge of trim 28 fits, slidably, into slot 60 in the support 55. The retainer 37 is shown affixed to support 55 and traversing slot 60. Again, a suitable slider mechanism can be utilized between the surfaces, if so desired. The rear edge of support 55 is shown in a slidably, interlocking relationship with the rear surface of the pier 25. That is, a suitable slot 30 is formed on the inner surface of the rear portion 29 of pier 25 to receive at least a portion 19 of the edge of support 55 so that the support can slide relative to the pier without becoming disengaged therefrom.

Thus, there is shown and described a unique design and concept of adjustable pier wall system. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A furniture unit comprising:

first and second furniture piers, wherein the first furniture pier is separate from the second furniture pier, and wherein the first furniture pier comprises a slot; and a unitary bridge coupling said first furniture pier to said second furniture pier, wherein at least a portion of said unitary bridge is received in said slot of the first furniture pier, said unitary bridge comprising a support plate having a cutout through an entire thickness of said support plate defining a first slot receiving at least a portion of one of said first and second furniture piers.

2. The unit recited in claim 1 wherein said bridge support plate comprises a second slot receiving at least a portion of one of said first and second furniture piers not received by the first slot.

3. The unit recited in claim 1 wherein the second furniture pier comprises a slot, said slot of the second furniture pier receiving at least a portion of the unitary bridge.

4. The unit recited in claim 3 wherein said bridge support plate comprises a second slot receiving at least a portion of one of said first and second furniture piers not received by the first slot.

5. The unit as recited in claim 4 further comprising:

a first retainer coupled to the support plate and traversing the first slot; and a second retainer coupled to the support plate and traversing the second slot.

6. The unit as recited in claim 1 further comprising a retainer coupled to the support plate and traversing the first slot.

7. The unit as recited in claim 6, wherein the support plate comprises a second slot, the unit further comprising a second retainer coupled to the support plate and traversing the second slot.

8. The unit recited in claim 1 wherein said first and second furniture piers can be slidably adjusted relative to said unitary bridge so that said first and second furniture piers can be spaced apart at a predetermined distance.

9. The unit recited in claim 1 wherein said first and second furniture piers can be slidably adjusted relative to said unitary bridge so that said first and second furniture piers are in side-by-side relationship.

10. A furniture unit comprising:

first and second furniture components;

a bridge coupled to each of said first and second furniture components, said bridge comprising a support plate having a first slot receiving at least a portion of said first component; and a retainer attached to said support plate, said retainer traversing said first slot and supporting said support plate against said received portion of said first furniture component.

11. The unit as recited in claim 10, wherein the support plate comprises a second slot for receiving at least a portion of said second furniture component.

12. The unit as recited in claim 11 further comprising a second retainer attached to said support plate traversing said second slot and supporting said support plate against said received portion of said second furniture component.

13. A furniture unit comprising:

first and second furniture components, wherein the first furniture component comprises a slot, and wherein the second furniture component comprises a slot;

a unitary bridge coupled to each of said first and second furniture components, wherein at least a portion of said unitary bridge is received in said slot of the first furniture component, wherein at least a portion of said unitary bridge is received in said slot of the second furniture component, said unitary bridge comprising a support plate having a first slot receiving at least a portion of one of said first and second furniture components and a second slot receiving at least a portion of one of said first and second furniture components not received by the first slot; and a first retainer coupled to the support plate and traversing the first slot; and a second retainer coupled to the support plate and traversing the second slot.

14. A furniture unit comprising:

first and second furniture piers, wherein the first furniture pier comprises a slot; and a unitary bridge coupled to each of said first and second furniture piers, wherein at least a portion of said unitary bridge is received in said slot of the first furniture pier, said unitary bridge comprising a support plate having a first slot and a second slot, the first slot receiving at least a portion of one of said first and second furniture piers;

a retainer coupled to the support plate and traversing the first slot; and second retainer coupled to the support plate and traversing the second slot.

15. A furniture unit comprising:

first and second furniture piers;

a bridge coupled to each of said first and second furniture piers, said bridge comprising a support plate having a first slot receiving at least a portion of one of said first and second furniture piers and a second slot for receiving at least a portion of one of said first and second furniture piers not received by the first slot; and a first retainer attached to said support plate, said retainer traversing said first slot; and a second retainer attached to said support plate traversing said second slot.

16. A furniture unit comprising:

first and second furniture piers, each pier comprising a decorative trim; and a unitary bridge having a decorative trim consistent with the decorative trim of the first and second furniture piers, said unitary bridge comprising a support plate having a first slot formed through the support plate receiving at least a portion of the first furniture pier decorative trim.

17. The unit as recited in claim 16, wherein the support plate further comprises a second slot formed through the support plate receiving the second furniture pier decorative trim.

18. The unit as recited in claim 17 wherein the decorative trim of the first and second furniture piers is identical in cross-section to at least a portion of the trim of the unitary bridge.

19. The unit as recited in claim 18 wherein the decorative trim of the first and second furniture piers is aligned with the at least a portion of the decorative trim of the unitary bridge which is identical to the trim of the first and second furniture piers when the trim of the first and second furniture piers is received in the first and second slots, respectively of the support plate.

20. The unit as recited in claim 17 further comprising a first and second retainers, said first retainer connected to the support plate traversing the first slot and said second retainer connected to the support plate and traversing the second slot.

21. The unit as recited in claim 20 wherein the first and second retainers rest against the portions of the first and second furniture pier decorative trim received in the first and second slot, respectively, retaining the support plate on the first and second furniture pier decorative trim.

22. The unit as recited in claim 21 wherein each of the first and second furniture piers comprises a slot each for receiving a portion of the support plate.

23. The unit as recited in claim 21 wherein each of the first and second furniture components comprises a slot each for receiving a portion of the support plate.

24. The unit as recited in claim 17 wherein each of the first and second furniture piers comprises a slot each for receiving a portion of the support plate.

25. The unit as recited in claim 20 wherein the first furniture pier comprises a slot receiving a portion of the support plate.

26. A furniture unit comprising:

first and second furniture components, wherein the first furniture component is separate from the second furniture component, and wherein the first furniture component comprises a slot;

a unitary bridge coupling said first furniture component to said second furniture component, wherein at least a portion of said unitary bridge is received in said slot of the first furniture component, said unitary bridge comprising a support plate having a cutout through said support plate defining a first slot receiving at least a portion of one of said first and second furniture components, wherein the second furniture component comprises a slot, said slot of the second furniture component receiving at least a portion of the unitary bridge, and wherein said bridge support plate comprises a second slot receiving at least a portion of one of said first and second furniture components not received by the first slot;

a first retainer coupled to the support plate and traversing the first slot; and a second retainer coupled to the support plate and traversing the second slot.

27. A furniture unit comprising:

first and second furniture components, each component comprising a decorative trim; and a unitary bridge having a decorative trim consistent with the decorative trim of the first and second furniture components piers, said unitary bridge comprising a support plate having a first slot formed through the support plate receiving at least a portion of the first furniture component pier decorative trim, wherein the support plate further comprises a second slot formed through the support plate receiving the second furniture component decorative trim; and a first and second retainers, said first retainer connected to the support plate traversing the first slot and said second retainer connected to the support plate and traversing the second slot, wherein the first and second retainers rest against the portions of the first and second furniture component decorative trim received in the first and second slot, respectively, retaining the support plate on the first and second furniture component decorative trim.

28. A furniture unit comprising:

first and second furniture components, each component comprising a decorative trim; and a unitary bridge having a decorative trim consistent with the decorative trim of the first and second furniture components piers, said unitary bridge comprising a support plate having a first slot formed through the support plate receiving at least a portion of the first furniture component pier decorative trim, wherein the support plate further comprises a second slot formed through the support plate receiving the second furniture component decorative trim, wherein each of the first and second furniture components comprises a slot each for receiving a portion of the support plate.

* * * * *